US008093304B2

(12) United States Patent
Varadaraj et al.

(10) Patent No.: US 8,093,304 B2
(45) Date of Patent: Jan. 10, 2012

(54) DEMULSIFICATION OF WATER-IN-OIL EMULSION

(75) Inventors: Ramesh Varadaraj, Flemington, NJ (US); Cornelius H. Brons, Easton, PA (US)

(73) Assignee: ExxonMobil Upstream Research Company, Houston, TX (US)

( * ) Notice: Subject to any disclaimer, the term of this patent is extended or adjusted under 35 U.S.C. 154(b) by 499 days.

(21) Appl. No.: 12/305,639

(22) PCT Filed: Jun. 14, 2007

(86) PCT No.: PCT/US2007/013901

§ 371 (c)(1),
(2), (4) Date: Dec. 18, 2008

(87) PCT Pub. No.: WO2008/020909

PCT Pub. Date: Feb. 21, 2008

(65) Prior Publication Data

US 2009/0166028 A1 Jul. 2, 2009

Related U.S. Application Data

(60) Provisional application No. 60/838,061, filed on Aug. 16, 2006.

(51) Int. Cl.
*B01D 17/05* (2006.01)
*E21B 43/22* (2006.01)

(52) U.S. Cl. ..... 516/141; 166/267; 166/310; 166/369

(58) Field of Classification Search ..... None
See application file for complete search history.

(56) References Cited

U.S. PATENT DOCUMENTS

| | | | |
|---|---|---|---|
| 1,500,202 | A | 7/1924 | Petty |
| 1,940,394 | A | 12/1933 | De Groote et al. |
| 2,290,411 | A | 7/1942 | De Groote et al. |
| 2,300,555 | A | 11/1942 | De Groote et al. |
| 2,324,492 | A | 7/1943 | De Groote et al. |
| 2,363,504 | A | 11/1944 | De Groote et al. |
| 2,568,741 | A | 9/1951 | Kirkpatrick et al. |
| 3,553,149 | A | 1/1971 | Schoen et al. |
| 4,160,742 | A | 7/1979 | Raman |
| 4,686,066 | A | 8/1987 | Hofinger et al. |
| 4,738,795 | A | 4/1988 | Farnand |
| 5,129,468 | A | 7/1992 | Parmenter |
| 5,154,857 | A | 10/1992 | Durrieu et al. |
| 6,068,054 | A | 5/2000 | Bragg |
| 6,077,400 | A | 6/2000 | Kartchner |
| 6,086,830 | A | 7/2000 | Kartchner |
| 6,168,702 | B1 | 1/2001 | Varadaraj et al. |
| 6,489,368 | B2 | 12/2002 | Varadaraj et al. |
| 6,491,824 | B1 | 12/2002 | Lin et al. |
| 6,555,009 | B2 | 4/2003 | Varadaraj |
| 6,599,949 | B2 | 7/2003 | Varadaraj et al. |
| 6,716,358 | B2 | 4/2004 | Varadaraj |
| 7,014,773 | B2 | 3/2006 | Varadaraj |
| 2004/0014821 | A1 | 1/2004 | Varadaraj |
| 2005/0258071 | A1 | 11/2005 | Varadaraj et al. |
| 2006/0183950 | A1 | 8/2006 | Varadaraj et al. |
| 2007/0111903 | A1 * | 5/2007 | Engel et al. ..... 507/261 |

FOREIGN PATENT DOCUMENTS

| | | | |
|---|---|---|---|
| WO | WO 2005/113726 | A1 | 12/2005 |
| WO | WO 2005/113727 | A2 | 12/2005 |
| WO | WO 2008/020907 | A2 | 2/2008 |
| WO | WO 2008/020908 | A2 | 2/2008 |

OTHER PUBLICATIONS

Deng, S. et al., "Destabilization of oil droplets in produced water from ASP flooding", *Colloids and Surfaces A*: Physicochem. Eng. Aspects 252, 2005, pp. 113-119, Elsevier Science Ltd., UK.

Gallup, D. L. et al., "West Seno Deepwater Development Case History-Production Chemistry", SPE 92969, SPE International Symposium on Oilfield Chemistry, Feb. 2-4, 2005, pp. 1-13, Houston, TX.

Grant, C. et al., "Long Distance Pipelining of Bitumous Froth", 47th Annual Technical Meeting of the Petroleum Society, Jun. 10-12, 1996, pp. 1-22, Calgary, AB, Canada.

Holloway, F. H., "The chemical treatment of offshore oil and gas production", SPE 6678, 1977, pp. 1-10.

Khan, Z. H. et al., "Improvement of the quality of heavily weathered crude oils", *Fuel*, 1995, pp. 1375-1381, v. 74 No. 9, Elsevier Science Ltd., UK.
Kokal S. et al., "Oil-Water Separation Experience from a Large Oil Field", SPE 93386, 14$^{TH}$ SPE Middle East Oil & Gas Conference, Mar. 12-15, 2005, pp. 1-9, Bahrain.
Mohtadi, M. F. et al., "Effect of Temperature on Flocculation of Aqueous Dispersions", *Water Research Pergamon Press*, 1973, pp. 747-767, v. 7, UK.
Peigne, G. et al., "Improving the Pumping of Viscous Oil by the Use of Demulsifiers or by an Annular Water Injection", 1998, 20$^{th}$ Annv. Oil Spill Conference, pp. 175-180, San Antonio, TX.
Varadaraj, R. et al., "Molecular Origins of Heavy Crude Oil Interfacial Activity, Part 1: Fundamental Interfacial Properties of Asphaltenes Derived from Heavy Crude Oils and Their Correlation to Chemical Composition", Energy & Fuels, 2007, pp. 195-198, v 21, Washington, DC.
Varadaraj, R. et al., "Molecular Origins of Heavy Crude Oil Interfacial Activity, Part 2: Fundamental Interfacial Properties of Model Naphthenic Acids and Naphthenic Acids Separated from Heavy Crude Oils", Energy & Fuels, 2007, pp. 199-204, v 21, Washington, DC.
Varadaraj, R. et al., "Molecular Origins of Heavy Crude Oil Interfacial Activity, Part 3: Characterization of the Complex Fluid Rag Layer Formed at Crude Oil-Water Interfaces", Energy & Fuels, 2007, pp. 1617-1621, v 21, Washington, DC.
Yang, M. et al., "Interactions Between Chemical Additives and Their Effects on Emulsion Separation", SPE 36617, SPE Annual Technical Conference, Oct. 6-9, 1996, pp. 453-463, Denver, CO.
European Search Report No. 114400, Apr. 18, 2007, 3 pages.

* cited by examiner

*Primary Examiner* — Zakiya W Bates
(74) *Attorney, Agent, or Firm* — ExxonMobil Upstream Research Company - Law Department

(57) ABSTRACT

A method of demulsifying a water-in-oil emulsion is provided. The method includes treating a volume of fluids comprising oil and water by adding a salt of a polynuclear, aromatic sulfonic acid to the fluids so as to cause the oil and water to be at least partially demulsified. The method may further include separating water and oil in a separator. A method of producing hydrocarbons from a subsurface reservoir is also provided. The hydrocarbons include a water-in-oil emulsion. The method includes producing the hydrocarbons through a wellbore, and subjecting the water-in-oil emulsion to a salt of a polynuclear, aromatic sulfonic acid additive so as to cause the oil and water to be at least partially demulsified.

51 Claims, 6 Drawing Sheets

60

$C_{12}(EO)_{12}$ OH :: $CH_3$-$(CH_2)_{11}$ - $(CH_2$-$CH_2$-$O)_{12}$ - OH 1,3,6-NTSS ::

DEMULSIFICATION OF WATER-IN-OIL EMULSION

CROSS REFERENCE TO RELATED APPLICATIONS

This application is the National Stage of International Application No. PCT/US2007/013901, filed 14 Jun. 2007, which claims the benefit of U.S. Provisional Application No. 60/838,061, filed 16 Aug. 2006.

BACKGROUND OF THE INVENTION

1. Field of the Invention

The present invention relates to the field of fluid separation. More specifically, the present invention relates to the separation of oil and water in connection with hydrocarbon production activities.

2. Background of the Invention

Effective separation of water from produced crude oil is a continuing need for the oil industry. Effective separation is particularly advantageous during the early stages of production of a well when there may be high water content. Even in wells that do not have significant initial water production, water cuts can increase over the life of a well to the point where the production fluids have to be treated to remove water.

When water is produced with oil it is frequently in the form of an emulsion. An emulsion is a heterogeneous liquid system consisting of two immiscible liquids, with one of the liquids being intimately dispersed in the form of droplets in the second liquid. The matrix of an emulsion is called the external or continuous phase, while the portion of the emulsion that is in the form of small droplets is called the internal, dispersed, or discontinuous phase.

In most emulsions of crude oil and water, the water is finely and spherically dispersed in the oil. This is referred to as a water-in-oil emulsion. The spherical form of the water droplets is a result of interfacial tension (IFT), which forces the water to present a minimum surface area to the oil.

The stability of an emulsion is controlled by the type and amount of surface-active agents present. In some instances, particularly with heavy oils, finely divided mineral solids existing within the production stream can act as emulsifying agents. The emulsifying agents form interfacial films around the droplets of the dispersed phase and create a barrier that slows down or inhibits coalescence of the water droplets.

The tendency of heavy oils to contain water-in-oil emulsions is attributable to the presence of certain hydrocarbon molecules sometimes found in heavy crudes. Particularly, asphaltenes and high naphthenic acids in heavy crudes tend to form stable, water-in-crude oil emulsions. The polar naphthenic acids and asphaltenes in the crude oil along with submicron size solids, such as silica, clay, and other minerals, undesirably stabilize heavy crude petroleum emulsions.

Crude oil dehydration treating systems are typically used to reduce the basic sediment and water (or "BS&W") of crude oil to a certain acceptable level specified by a crude oil purchaser such as a pipeline company. The level of sediment and water typically specified by purchasers is less than 1% by volume. In particular, with bitumen produced from oil sands, both water and solids result from the oil sands extraction process. This means that solids have to be separated from the crude oil.

It has been known to separate water from crude oil in storage tanks using mechanical separators and gravitation. However, when water forms a stable emulsion with heavy crude oil, the use of storage tanks and mechanical separators may be difficult. This is particularly true with emulsions of heavy oil and water produced from a reservoir formation. Such crude oil fluids can contain from about 1% to about 60% water by volume. A common range of emulsified water in crude oil heavier than 20° American Petroleum Institute (API) is from 10% to 35%.

In an effort to further separate produced water from crude oil, it is also known to treat the well stream with chemicals. These chemicals are referred to as dehydration chemicals or demulsifiers. Various chemical additives have been used with some effect in treating water-in-oil emulsions. Commercially available chemical demulsifiers such as ethoxylated-propoxylated phenolformaldehyde resins and ethoxylated-propoxylated alcohols are used for demulsification of crude oils. Demuslifiers counteract the emulsifying agent, allowing the dispersed droplets of the emulsion to coalesce into larger droplets and settle out of the matrix. However, the effectiveness of these demulsifiers on heavy crude oils, particularly those containing asphaltenes, naphthenic acids and inorganic solids, may be limited.

U.S. Pat. No. 6,491,824 discloses the treatment of sludge emulsions. Various "emulsion breakers" are listed, including dodecylbenzylsulfonic acid (DDBSA), the sodium salt of xylenesulfonic acid (NAXSA), epoxylated and propoxylated compounds, anionic cationic and nonionic surfactants, and resins such as phenolic and epoxide resins. Additional examples of demulsifiers are disclosed in U.S. Pat. No. 1,500,202; U.S. Pat. No. 2,290,411; U.S. Pat. No. 2,568,741; U.S. Pat. No. 2,324,492; U.S. Pat. No. 3,553,149; U.S. Pat. No. 4,160,742; U.S. Pat. No. 4,686,066; and U.S. Pat. No. 4,738,795.

Where the crude oil is heavy oil, it is common to also employ gravity and electrostatic separators. Gravity settling and centrifugation in conjunction with chemical demulsifiers have also been employed. It is also known to treat the heavy oil with light oil or distillate along with the demulsifier. In some instances, demulsifiers are formulations containing about 50% weight (wt.) of a carrier solvent and 50% wt. of active demulsifying ingredients. The ingredients are commonly demulsifier molecules that are linear or branched alkyl chain ethoxylated alcohols.

In some cases, known technologies for the separation of water from heavy oil result in an intermediate emulsion rag layer. Further processing of the rag layer can be useful to recover the crude oil and discharge the water. The problem is faced both at production facility separators and in refinery oil/water separators. Recently, a microwave technology has been disclosed in U.S. Pat. Nos. 6,086,830 and 6,077,400 which discuss the use of microwaves for treatment of hard-to-treat emulsions.

Regardless, improved demulsifiers for heavy crude oil emulsions and for bitumen emulsions are needed. Also, a need exists for a new additive that reduces the rag layer. Further, a need exists for a method of demulsifying a water-in-oil emulsion using a salt of a polynuclear aromatic sulfonic acid.

SUMMARY OF THE INVENTION

A new family of demulsifier additives is described to be used in the separation of oil/water emulsions. With the new demulsifier additives, a method of demulsifying a water-in-oil emulsion is provided. In one aspect, the method comprises treating a volume of fluids comprising the water-in-oil emulsion by adding a salt of a polynuclear, aromatic sulfonic acid to the fluids so as to cause the oil and water to be at least partially demulsified. The method may further include separating water from the oil in a separator.

The oil in the fluids may be any oil, including any one of heavy crude oil, bitumen, crude oil distillates and synthetic oils. The water may be any aqueous solution typically found in oil-bearing strata, including brine. The fluids may contain other materials such as stabilizing fine solids (e.g., silica, clay, and barium sulfate ($BaSO_4$)) and asphaltenes, naphthenic acid compounds, resins, and mixtures thereof.

The demulsifier additive is sometimes referred to as a polynuclear aromatic sulfonic acid (PASS) additive. Preferably, the PASS additive is derived from the chemical formula $$Ar—(SO_3^-X^+)_n$$

where:

"Ar" is a homonuclear or heteronuclear aromatic ring of at least 6 carbon atoms, "X" is selected from Group I and II elements of the long form of The Periodic Table of Elements, and "n" ranges from 1 to 10.

The salt may, for instance, be a sodium salt, a potassium salt, a calcium salt, or a magnesium salt. Preferably, the polynuclear, aromatic sulfonic acid contains no alkyl substituents.

Non-limiting examples of suitable PASS additives include:
1-naphthalene sulfonic acid;
2,6 naphthalene disulfonic acid;
1,5 naphthalene disulfonic acid;
1,3,6 naphthalene trisulfonic acid; and
1,3,6,8-pyrene tetrasulfonic acid.

The PASS additives may also be mixtures of two or more sodium salts of polynuclear, aromatic sulfonic acids.

In one aspect of the method, the oil in the fluids comprises heavy oil, and the treating the volume of fluids is performed at a production site. In another aspect, the oil in the fluids comprises a heavy oil-light oil blend, and the treating the volume of fluids is performed in a refinery desalter.

A method of producing hydrocarbons from a subsurface reservoir is also provided. The hydrocarbons comprise a water-in-oil emulsion. In one aspect, the method includes producing the hydrocarbons through a wellbore, and subjecting the water-in-oil emulsion to a salt of a polynuclear, aromatic sulfonic acid additive so as to cause the oil and water to be at least partially demulsified.

The method may further include separating water from oil in a separator. The separator may be, for example, one of a centrifugation separator, a gravity settling separator, a hydrocyclone, a separator that applies an electrostatic field, and a separator that applies microwave treatment.

In one aspect, the oil in the emulsion comprises heavy oil, and subjecting the water-in-oil emulsion to a salt of a polynuclear, aromatic sulfonic acid is performed at a production site. In another aspect, the oil in the fluids comprises a heavy oil-light oil blend, and the subjecting the water-in-oil emulsion to a salt of a polynuclear, aromatic sulfonic acid is performed in a refinery desalter.

In one aspect, the oil in the fluids comprises heavy oil, and subjecting the water-in-oil emulsion to a PASS additive is performed by injecting the additive into the wellbore. In another aspect, subjecting the water-in-oil emulsion to a PASS additive is performed by injecting the additive through the wellbore and into a reservoir formation from which the hydrocarbons are produced.

A method of demulsifying a water-in-oil emulsion is also provided. In one aspect, the method includes producing a volume of fluids comprising the water-in-oil emulsion, and treating the emulsion with an additive comprising a salt of a polynuclear, aromatic sulfonic acid so as to cause the oil and water to be at least partially demulsified. In one embodiment of the method, the additive has the structure:

$$Ar—(SO_3^-X^+)_n$$

with:

"Ar" being a homonuclear or heteronuclear aromatic ring of at least 6 carbon atoms, "X" is selected from Group I and II elements of the long form of The Periodic Table of Elements, and "n" ranges from 1 to 10.

"X" is preferably selected from the group of elements consisting of sodium, potassium, calcium and magnesium.

The fluids in the emulsion may further comprise at least one of fine mineral solids, asphaltenes, organic acids, basic nitrogen compounds, and mixtures thereof. In one aspect, the oil in the emulsion comprises heavy oil, and treating the water-in-oil emulsion is performed at a production site.

The additive preferably is present in a concentration of from about 0.001% wt. to about 5.0% wt. of the emulsion. The additive may be delivered through a solvent as a delivery carrier. The delivery solvent may be present in an amount of from about 35% wt. to about 75% wt. in the demulsifier, included in the weight percent of the additive added to the emulsion. The additive may be present in the emulsion in a concentration of from about 10 parts per million (ppm) to about 1,000 ppm.

BRIEF DESCRIPTION OF THE DRAWINGS

So that the manner in which the features of the present invention can be better understood, certain drawings, charts and micrographs are appended hereto. It is to be noted, however, that the drawings illustrate only selected embodiments of the inventions and are therefore not to be considered limiting of scope, for the inventions may admit to other equally effective embodiments and applications.

FIG. 8A is data for the starting emulsion from FIG. 7A, while FIG. 8B is the data for the 1,3,6-NTSS treated emulsion. An order of magnitude increase in droplet diameter was observed upon 1,3,6-NTSS treatment.

DETAILED DESCRIPTION OF CERTAIN EMBODIMENTS

Definitions

Figure 1:
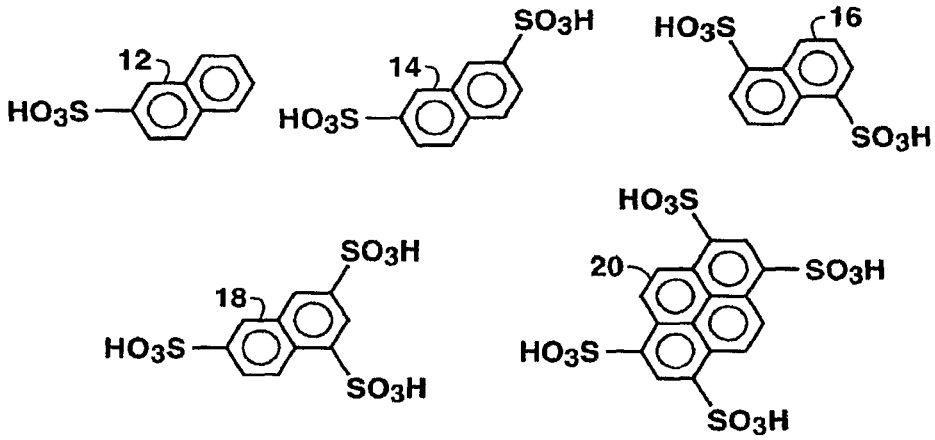
FIG. 1 is chemical structures of certain illustrative polyaromatic sulfonic acids. The sodium salts of these compounds were evaluated.

As used herein, the term "PASS" refers to the salts of polynuclear aromatic sulfonic acids. Non-limiting examples include sodium and potassium salts.

The term "polynuclear aromatic sulfonic acid" refers to any group of organic compounds having multiple aromatic rings and a sulfonic functional group.

The term "demulsification" refers to an action by a demulsifier to attract water droplets, and bring them together. The terms "demulsifier" means any surface active agent that acts to separate water from oil, and to cause water droplets to be attracted to one another.

The term "bitumen" means any naturally occurring, non-crystalline solid or viscous hydrocarbon material that is substantially soluble in carbon disulfide.

"Hydrocarbons" are organic material with molecular structures containing carbon and hydrogen. Hydrocarbons may also include other elements, such as, but not limited to, halogens, metallic elements, nitrogen, oxygen, and/or sulfur.

"Oil" means a fluid containing a mixture of condensable hydrocarbons.

The term "heavy oil" refers to viscous hydrocarbon fluids, having a viscosity generally greater than about 100 centipoise at ambient conditions (15° C. and 1 atmosphere (atm) pressure). Heavy oil generally has an API gravity below about 20° and most commonly about 10° to 20°. Heavy oil may include carbon and hydrogen, as well as smaller concentrations of sulfur, oxygen, and nitrogen. Heavy oil may also include aromatics or other complex ring hydrocarbons.

The term "wellbore" refers to a hole in a formation made by drilling or insertion of a conduit into the formation. A wellbore may have a substantially circular cross section, or other cross-sectional shapes (e.g., circles, ovals, squares, rectangles, triangles, slits, or other regular or irregular shapes). As used herein, the terms "well" and "opening," when referring to an opening in the formation may be used interchangeably with the term "wellbore."

The terms "production fluids" or "produced fluids" refer to fluids produced from a hydrocarbon-bearing formation or reservoir. Such fluids may carry solid materials, and may include fluids and solids previously injected during drilling or well treatment. Such fluids may or may not contain organic acids such as asphaltenes.

Description of Specific Embodiments

A new family of demulsifier additives for demulsification of oil and water emulsions is disclosed. The oil of the emulsion can be of any type of oil including crude oils, crude oil distillates, bitumen, synthetic oils, crude oil-light oil blends, and mixtures thereof. The oils forming the emulsion may also include crude oil residuals obtained from atmospheric or vacuum distillation units. However, the preferred application for the demulsifier additives is for heavy crude oil emulsions and bitumen emulsions.

The additive and processes herein are applicable to any type of water-in-oil emulsion, including those which contain solids. Typically, the solids, if present in the emulsion, have an average total surface area of about 1,500 square microns or less, more preferably about 25 to about 1,500 square microns, even more preferably about 50 to 1,500 square microns, and most preferably still, about 100 to about 1,500 square microns. The solids present can be those naturally occurring in crude oil, such as clay, silica, refinery coke, and various solid minerals. The solids may likewise have been intentionally added to form the emulsion. The solids may be other solids introduced during drilling operation or a well workover procedure. Typically, barium sulfate ($BaSO_4$) is used in drilling muds, and calcium carbonate ($CaCO_3$) may be introduced into the drilling operations in "kill-pills". When solids are present, they contribute to stabilizing the emulsion and such emulsions are referred to as solids-stabilized emulsions.

The demulsifier additive is also effective for crude oil emulsions that include asphaltenes, organic acids, basic nitrogen compounds and mixtures thereof. The demulsifying agent is also applicable to any water-in-oil emulsion that includes emulsifiers, which are added for forming the emulsion (such as surfactants) or emulsifiers that are naturally present in the produced hydrocarbons.

The aqueous phase of the emulsion comprises water. The water may constitute "brine," and may include dissolved inorganic salts of chloride, sulfates and carbonates of Group I and II elements of the long form of The Periodic Table of Elements. Organic salts can also be present in the aqueous phase. The demulsifier additive is effective for crude oil emulsions that include brine.

The proposed demulsifier additives are salts of polynuclear aromatic sulfonic acids, or "PASS" additives. Preferably the PASS additives are sodium or potassium salts. Preferably, the polynuclear aromatic groups contain no alkyl substituents.

Particularly preferred PASS demulsifiers are polynuclear aromatic sulfonic acid salts (PASS compounds) having the structure:

$$Ar—(SO_3^-X^+)_n$$

wherein:

"Ar" is a homonuclear or heteronuclear aromatic ring of at least 6 carbon atoms, "X" is selected from the group consisting of sodium, potassium, calcium and magnesium, and "n" ranges from 1 to 10.

FIG. 1 presents a series of chemical structures for different molecules. Each molecule represents an illustrative aromatic sulfonic acid. The aromatic compounds demonstrated in FIG. 1 are:

1-naphthalene sulfonic acid (1-NSS) 12,
2,6-naphthalene disulfonic acid (2,6-NDSS) 14,
1,5-naphthalene disulfonic acid (1,5-NDSS) 16,
1,3,6-naphthalene trisulfonic acid (1,3,6-NTSS) 18, and
1,3,6,8-pyrene tetra sulfonic acid (1,3,6,8-PTSS) 20.

It is understood that the numerical listings before the compounds indicate the position of the substituent on the aromatic rings. However, other positions on the rings may be suitable. Thus, the above list is merely illustrative.

Polynuclear aromatic sulfonic acid (PASS) compounds, such as those of FIG. 1, are available from Aldrich Chemical Company, Inc. of Milwaukee, Wis. They are available as sodium salts of the aromatic sulfonic acids. Sodium salts or salts of other Group I elements are preferred.

Applicant has conducted tests to confirm the suitability of sodium salts of the polynuclear aromatic sulfonic acid compounds as a demulsifying agent in the oil industry. In the demulsification of crude oil and water, certain characteristics of demulsifiers are desirable. For instance, demulsifiers should be water soluble. Demulsifiers should also be thermally stable to temperatures over 100° C., and preferably up to even 500° C. Also, a demulsifier should not decrease the interfacial tension between heavy oil and water.

Figure 2:
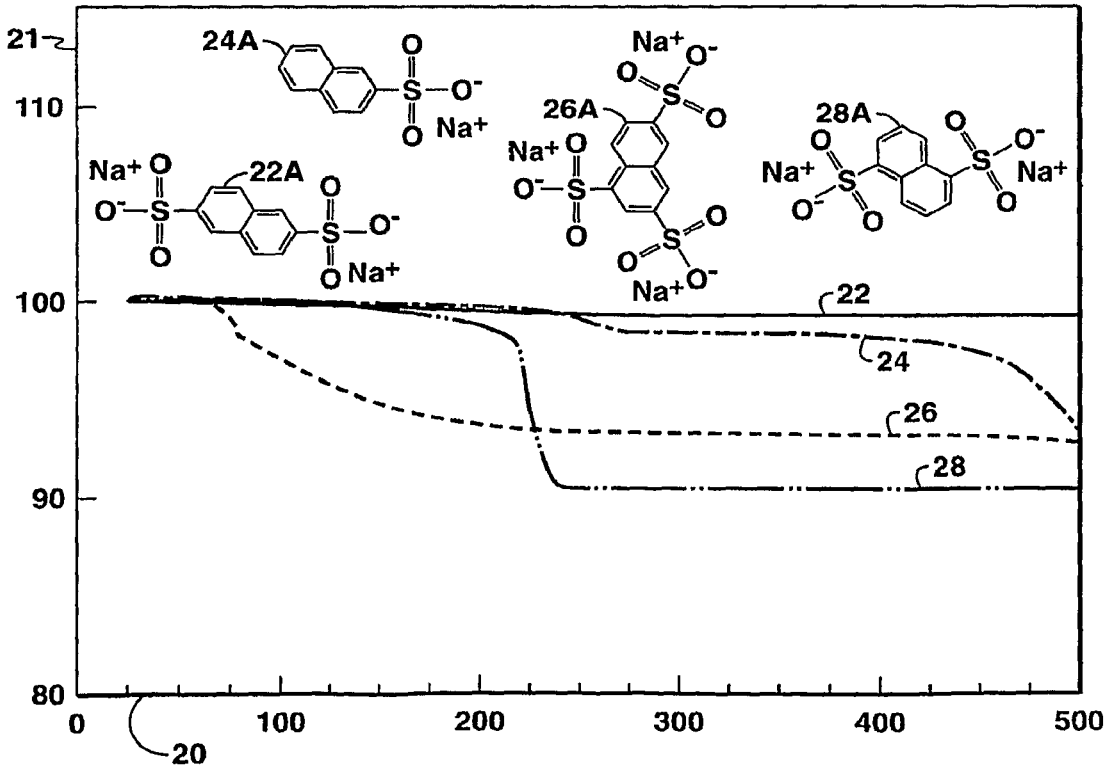
FIG. 2 is results of a Thermogravimetric Analysis (TGA) of certain of the sodium salts of the compounds of FIG. 1.

FIG. 2 demonstrates a Thermogravimetric Analyses (TGA) test for sodium salts of four PASS additives. The four PASS molecules are:

2,6-naphthalene disulfonic acid sodium salt (denoted at 22), 2-naphthalene sulfonic acid sodium salt (denoted at 24), 1,3,6-naphthalene trisulfonic acid sodium salt hydrate (denoted at 26), and 1,5-naphthalene disulfonic acid sodium salt hydrate (denoted at 28).

Chemical structures for the four PASS molecules 22, 24, 26, 28 are shown at the top of FIG. 2 and denoted as 22A, 24A, 26A, and 28A respectively.

The TGA chart of FIG. 2 provides a plot of temperature 20 (measured in degrees Celsius) on the x-axis, versus percent 21 (by weight) of solution on the y-axis. It is shown that as temperature 20 increases, the weight percent 21 drops, but by less than 10% in each case. Therefore, it is demonstrated that the PASS compounds are thermally stable. Indeed, the PASS compounds were thermally stable even up to 450° C.

Figure 3:
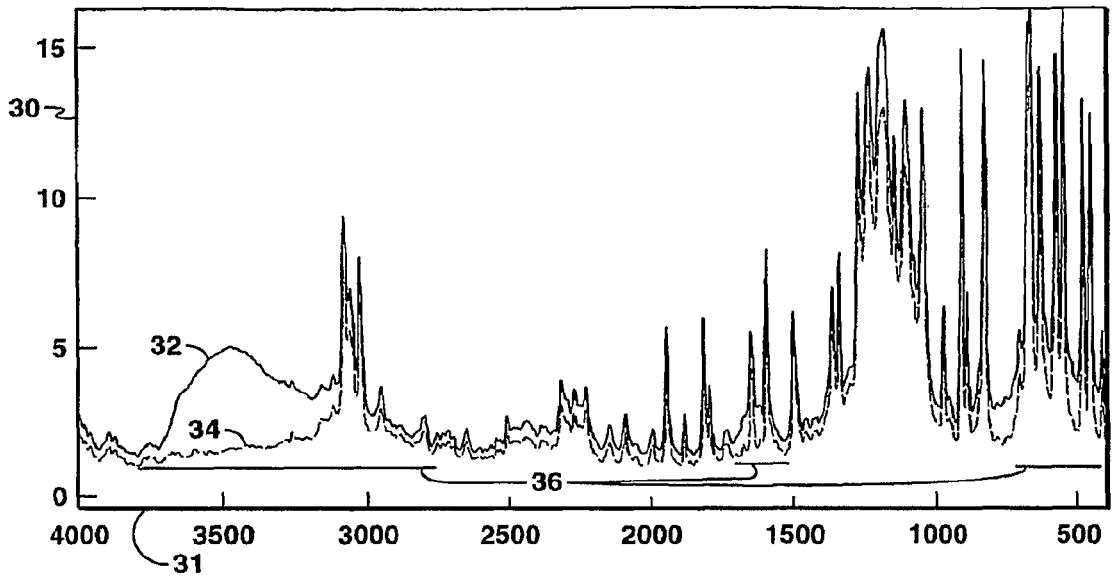
FIG. 3 is a Fourier Transform Infrared (FTIR) spectrum of 2,6-naphthalene sulfonic acid disodium salt, comparing thermal stability before and after TGA.

FIG. 3 demonstrates another test conducted on a PASS compound plotting results on y-axis of peak intensity 30 and x-axis of Emission/Wavenumber ($cm^{-1}$) 31. A Fourier Transform Infrared (FTIR) spectrum was performed on the PASS additive 2,6-naphthalene sulfonic acid disodium salt. Separate FTIR tests were performed before and after TGA. Thus, two different spectra are presented.

It can be seen from FIG. 3 that the two spectra have very similar fingerprints. Except for the loss of water of hydration 36, no change is observed in the FTIR spectrum. This indicates that the additives are thermally stable and fail to degrade upon heating up to 500° C. This also shows that the PASS compounds are water soluble.

Next, an interfacial tension, or IFT test was conducted. A tensiometer was used in connection with a Pendant prop method to test heavy oil/water interfacial tension. Two different fluids were tested. The table below lists the measured oil/water interfacial tension of an untreated Athabasca bitumen versus an Athabasca bitumen treated with 1-wt % solution of the sodium salt of naphthalene trisulfonic acid (1,3,6-NTSS). Testing was done for both fluids at 70° C.

| Interface | IFT @ 70° C. (dynes/cm) |
|---|---|
| Athabasca Bitumen/Water | 1.5 to 2.0 |
| Athabasca Bitumen/Water + 1% 1,3,6-NTSS | 1.5 to 2.0 |

It can be seen that no decrease in interfacial tension between the heavy oil and water is observed. In this respect, the IFT of each fluid was 1.5 to 2.0 dynes/centimeter (cm). This confirms that the PASS compounds do not exhibit a tendency to emulsify water into heavy oil. This is a desirable characteristic for a heavy oil demulsifier.

Adsorption testing of a PASS compound was also conducted. Once again, the PASS compound tested was 1,3,6-NTSS. To perform the testing, asphaltenes were separated from Athabasca bitumen by a standard separation process of solvent deasphalting with n-heptane. The separated asphaltenes were used as the adsorbent, while 1,3,6-NTSS was used as the adsorbate. Seven solutions of 1,3,6-NTSS in the concentration range of $10^{-4}$ to 103 moles/liter were prepared. A 5 milliliter (ml) portion of the aqueous adsorbate solution was added to 0.5 grams of powered asphaltenes. Each mixture was shaken on a wrist shaker for 30 minutes.

Figure 4:
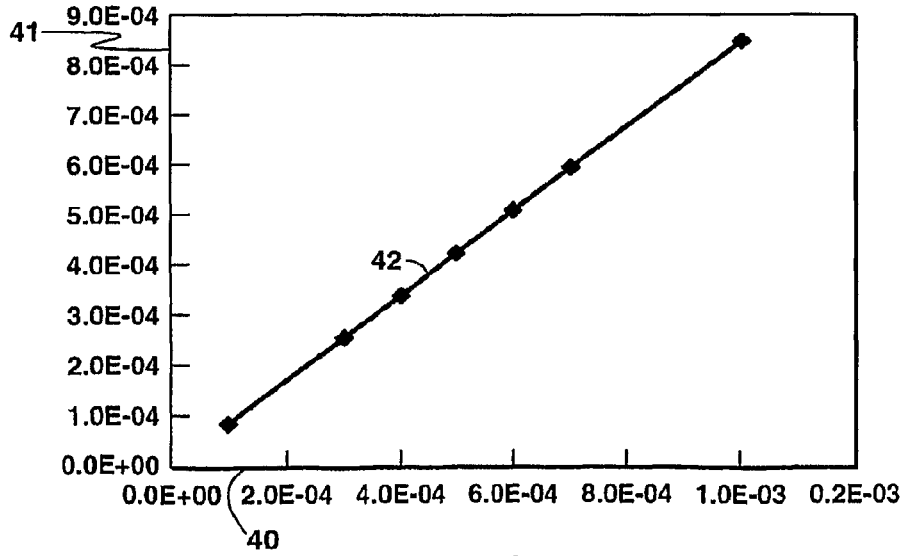
FIG. 4 displays an adsorption isotherm for 1,3,6-NTSS naphthalene trisulfonic acid adsorption on asphaltenes.

After completion of the mixing and contacting, the concentration of 1,3,6-NTSS in the water phase was determined by UV-Visible absorption spectroscopy. FIG. 4 provides an adsorption isotherm for NTSS adsorption on Athabasca asphaltenes. A Cartesian coordinate plotting NTSS solution concentration 40 (measured in moles) against NTSS particles adsorbed 41 (also measured in moles) is presented. It can be seen from FIG. 4 that as the concentration of the PASS compound 40 increases, the adsorption 41 also increases in linear relation 42. Specifically, an adsorption equilibrium constant of 0.85 was measured. This value indicates strong adsorption of the 1,3,6-NTSS to heavy oil asphaltenes.

Next, testing was conducted to determine whether the PASS molecules alter the wetting character of heavy oil. Effective wetting of heavy oil without a reduction in heavy oil-water interfacial tension is desirable for an effective demulsifier of heavy oils. To make this determination, a contact angle wetting experiment was performed.

First, untreated Athabasca bitumen was coated on a glass slide. A water droplet was then placed onto the coated slide. The contact angle between oil and water was measured. As can be seen, a contact angle to water was measured as 130 degrees. This indicates that the surface of Athabasca bitumen is hydrophobic.

Next the Athabasca bitumen was treated with 1,3,6-NTSS. 5.0 g (acceleration due to gravity) of bitumen was mixed with 1 ml of a 0.1% NTSS solution at 70° C. The mixture was heated to 100° C. to evaporate off the water. The treated Athabasca bitumen was then coated on a separate glass slide. A contact angle to water of 0° was observed. Thus, the PASS molecule altered the wetting character of heavy oil. The contact angle experiment confirms the excellent wetting property of the PASS compounds.

The experiments described above demonstrate that PASS molecules possess the fundamental properties necessary to be effective demulsifying agents for heavy oils. The amount of demulsifier to be used for treatment in the field ranges from about 0.001%-wt. to about 5.0%-wt based on the amount of the emulsion. In one aspect, the PASS additive is provided at a range of about 10 parts per million (ppm) to about 2,000 ppm. Preferably, the PASS additives are present in the emulsion at about 100 ppm to about 1,000 ppm.

In treating an oil/water emulsion with a PASS additive, a delivery carrier may optionally be employed. The delivery carrier may be water, or alternatively it may be a solvent. Preferred solvents include crude oil distillates boiling in the range of about 70° C. to about 450° C., alcohols, ethers and mixtures thereof. The delivery solvent is present in an amount of from about 35% wt. to about 75% wt. in the demulsifier. When utilized, the delivery solvent is included in the about 0.1 wt % to about 5.0 wt % demulsifier added to the emulsion.

Following demulsifier treatment, the emulsion is subject to separation methods such as centrifugation, gravity settling, hydrocyclones, application of an electrostatic field, microwave treatment or combinations thereof, or by any other methods known to the skilled artisan for phase separation. For example, centrifugation can be conducted at 500 to 150,000 g for about 0.1 to about 6 hours or more, and electrostatic field application of about 500-5,000 volts/inch for about 0.1 to about 24 hours or more. The oil may then be recovered as a separate phase. The process may be conducted at temperatures of the water-in-oil emulsion of about 20° C. to about 200° C., and at pressures from ambient to 200 pounds per square inch gauge (psig) or 1,480.4 kPa.

EXPERIMENTAL

It has been demonstrated that sodium salts of polynuclear aromatic sulfonic acids (PASS) exhibit a unique combination of properties that render them effective for the demulsification of water-in-oil emulsions of heavy oil. To further confirm their effectiveness, additional laboratory experiments were conducted to demonstrate the demulsification effectiveness of PASS molecules.

Example 1

In the first experiment, a 30/70::ratio water/Athabasca bitumen emulsion was prepared by adding water to froth treated Athabasca bitumen. The mixture was sheared using a Silverson mixer for 15 minutes at a shear rate of 4,000 $sec^{-1}$. During the mixing process, the temperature was observed to rise to about 65° C. After mixing, the emulsion was placed under a LASENTEC® probe and demulsification experiments were conducted. For example, the emulsion was subject to particle sizing analyses. The dispersed water droplets were observed using a particle video monitor (PVM), and the micrographs were recorded. Changes in particle size distribution were determined quantitatively using the focused beam laser reflection (FBR) method.

Figure 5A:
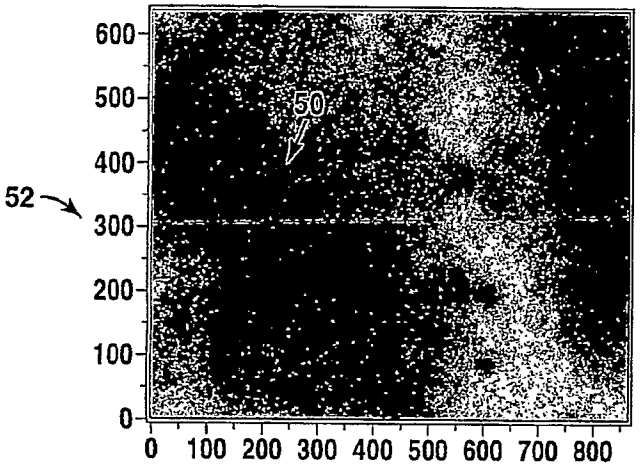
FIGS. 5A, 5B, 5C and 5D are micrographs comparing water droplet size for a 30% water-in-froth bitumen solution treated with a linear alkyl chain ethoxylate $C_{12}(EO)_{12}OH$ (FIG. 5B) versus the emulsion treated with the 1,3,6-NTSS PASS compound (FIGS. 5C and 5D). A micrograph for an untreated "control" solution is shown in FIG. 5A.

A micrograph 52 for the untreated Athabasca emulsion is shown in FIG. 5A. An arrow is used to indicate one of the water droplets 50 visible within the emulsion. Other small water droplets are visible. The untreated emulsion serves as the control for the experiment.

Figure 6:
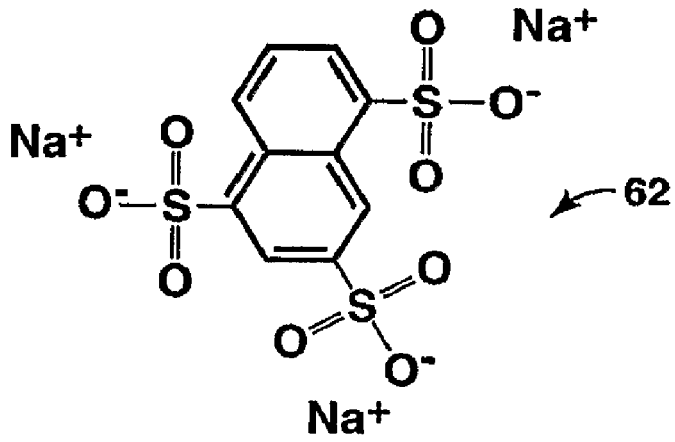
FIG. 6 is chemical features of two demulsifier additives subject to experimentation. The chemical formula for the linear alkyl chain ethoxylate $C_{12}(EO)_{12}OH$ is shown. The chemical structure of the PASS compound 1,3,6-naphthalene trisulfonic acid (1,3,6-NTSS) is also shown.

Next, the Athabasca bitumen was treated with two different demulsifiers. One demulsifier was the linear alkyl chain ethoxylate $C_{12}(EO)_{12}OH$ (with "E" referring to $CH_2CH_2$ ethoxy). This was selected as the benchmark demulsifier because it is representative of the family of one of the most widely used demulsifiers in commercial demulsifier packages. The chemical formula for this known demulsifier is shown in FIG. 6 at 60. The other demulsifier was the PASS compound 1,3,6-naphthalene trisulfonic acid (1,3,6-NTSS). The chemical structure for the PASS compound is also shown in FIG. 6 at 62.

Figure 5B:
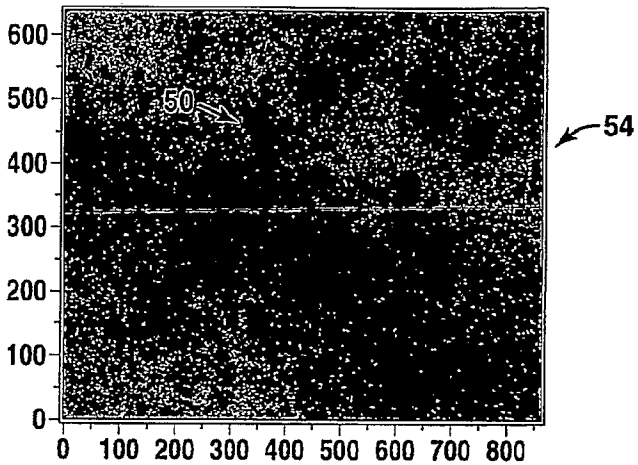
Figure 5C:
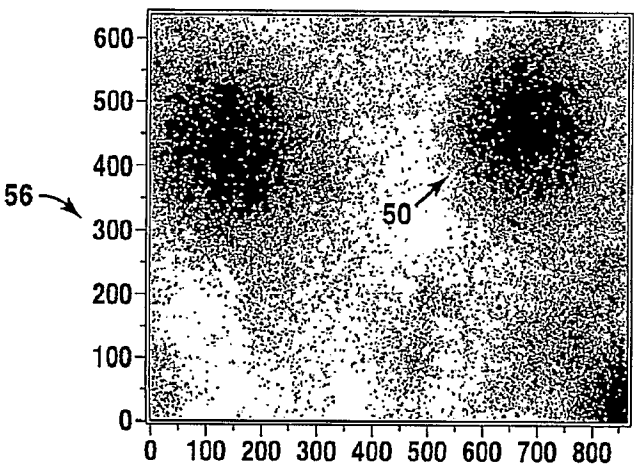
Figure 5D:
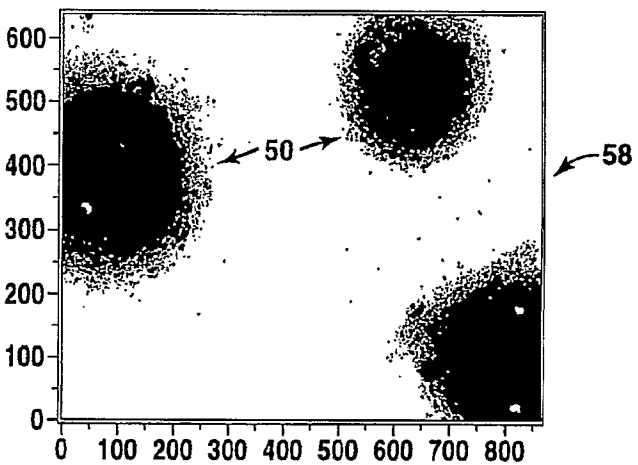

The results of the comparative evaluation are shown in the micrographs of FIGS. 5B, 5C and 5D. FIG. 5B presents a micrograph 54 for the emulsion treated with the known commercial demulsifier linear alkyl chain ethoxylate. Additional water droplets (visible as black droplets 50) compared to the control 52 shown in FIG. 5A are apparent.

FIG. 5C is a micrograph 56 for the emulsion treated with the new PASS additive. It can be seen that larger water droplets 50 have formed in this micrograph 56. The PASS-treated emulsion of micrograph 56 was allowed to sit for 30 minutes. FIG. 5D provides a micrograph 58 for the quiescent emulsion. It can be seen that the emulsion was substantially demulsified, producing large water globules 50. Thus, it is demonstrated from the micrographs 56, 58 of FIGS. 5C and 5D that larger water droplets 50 were formed using the PASS compound than using the benchmark commercial demulsifier.

Example 2

Figure 7A:
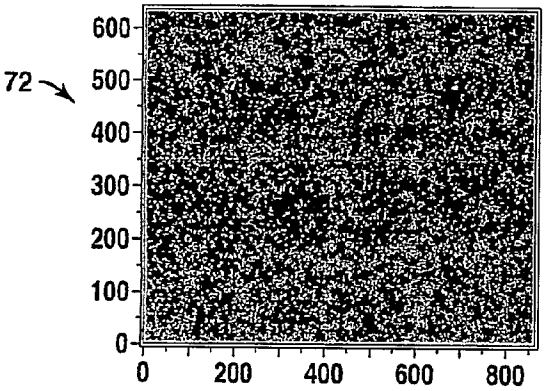
FIGS. 7A, 7B, 7C, 7D and 7E are micrographs showing water droplet size comparisons for a 30% water-in-naptha diluted bitumen solution. One solution was treated with a 0.01 wt % solution of $C_{12}(EO)_{12}OH$ (FIG. 7B), while another was treated with a 0.01 wt % solution of a 1,3,6-NTSS PASS compound (FIGS. 7C, 7D and 7E). A micrograph for an untreated "control" solution is also shown (FIG. 7A).

FIGS. 7A, 7B, 7C, 7D and 7E provide micrographs of emulsions in a second experiment. In the second experiment, an Athabasca bitumen was diluted with naphtha diluent on a 0.6:1 naptha:bitumen volume basis. A 30/70::water/naphtha diluted Athabasca bitumen emulsion was prepared as described above, and subjected to the same evaluation and analyses protocol. FIG. 7A presents a micrograph 72 for the starting, untreated emulsion. No water droplets are visible.

Figure 7B:
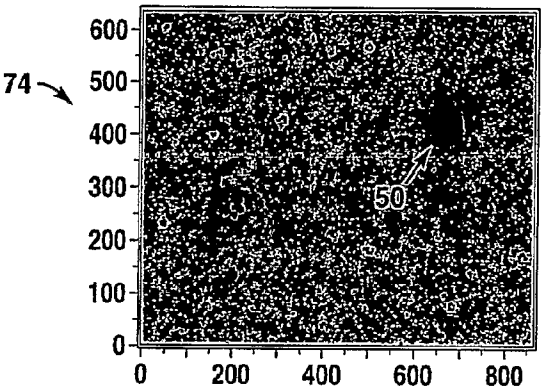
Figure 7C:
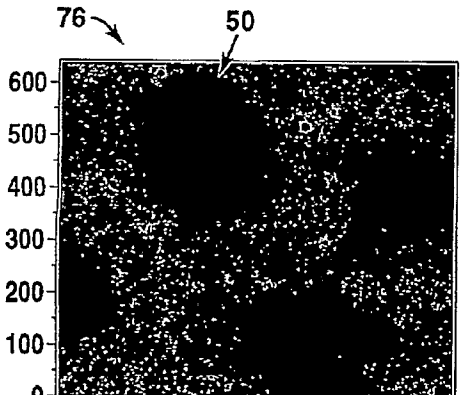
Figure 7D:
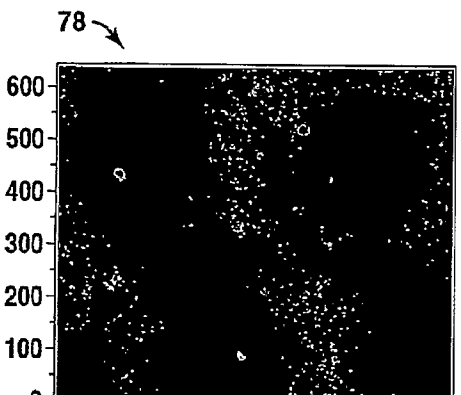
Figure 7E:
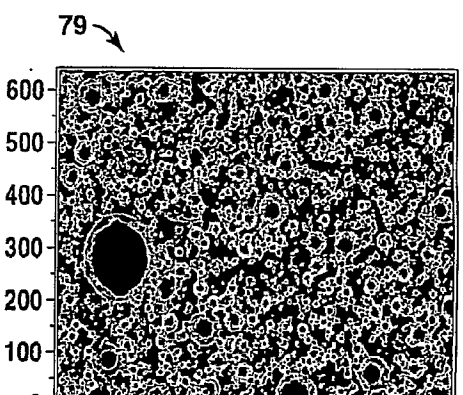

FIGS. 7A, 7B, 7C, 7D and 7E are micrographs showing water droplet size comparisons for a 30% water-in-naptha diluted bitumen solution. One solution was treated with a 0.01 wt % solution of $C_{12}(EO)_{12}OH$ (FIG. 7B), while another was treated with a 0.01 wt % solution of a 1,3,6-NTSS PASS compound (FIGS. 7C, 7D and 7E). A micrograph for an untreated "control" solution is also shown (FIG. 7A).

The emulsion was then treated with two demulsifiers. Again, one demulsifier was the linear alkyl chain ethoxylate $C_{12}(EO)_{12}OH$, used as the benchmark. A 0.01 wt % solution of $C_{12}(EO)_{12}OH$ was used. The other demulsifier was the PASS compound 1,3,6-naphthalene trisulfonic acid (1,3,6-NTSS). A 0.01%-wt solution of each demulsifier was used. Each emulsion was treated and allowed to stay quiescent for 15 minutes.

FIG. 7B shows a micrograph 74 of the emulsion treated with $C_{12}(EO)_{12}OH$. One large droplet of water 50 is seen, along with several smaller, less developed droplets. FIGS. 7C, 7D and 7E provide micrographs 76, 78, 79 for the emulsion treated with the PASS additive. Different magnification views of the PASS-treated emulsion are provided. It can be realized from the bottom micrographs 76, 78, 79 that more robust water droplets 50 formed using the PASS compound than using the benchmark commercial demulsifier. Treatment with the 1,3,6-NTSS solution resulted in a substantial increase in the water droplet size compared to both the control and the $C_{12}(EO)_{12}OH$ demulsifier. Droplet coalescence and phase separation of the water occurred in the 1,3,6-NTSS treated sample.

Figure 8B:
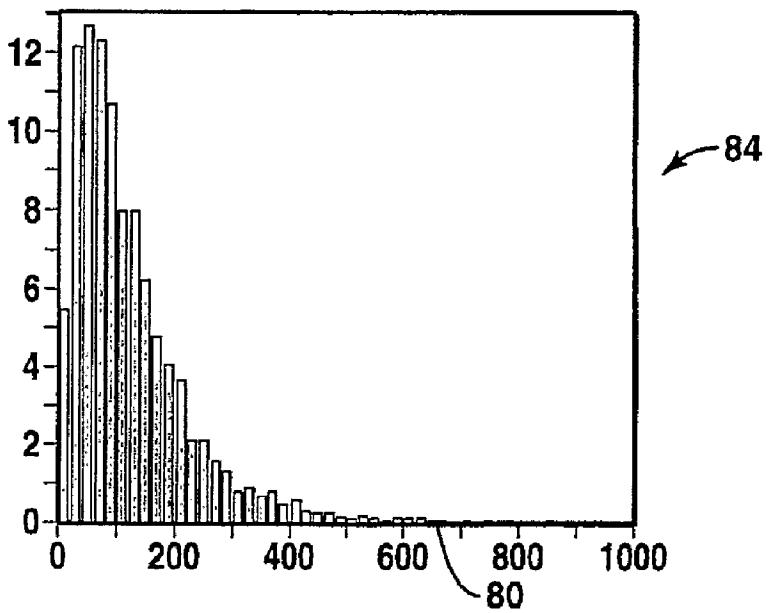
FIGS. 8A and 8B display droplet size distribution data.
Figure 8A:
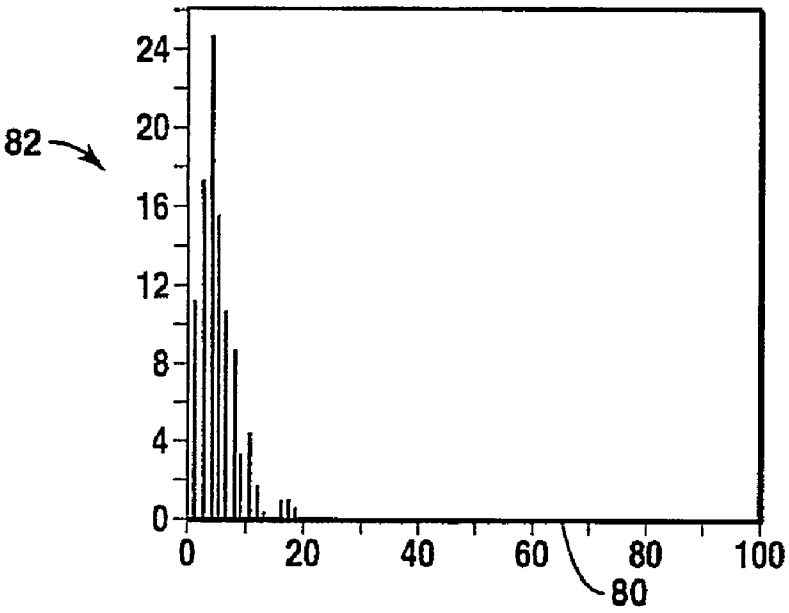

Finally, FIGS. 8A and 8B display droplet size (chord length in microns) distribution data for the starting emulsion from FIG. 7A and the 1,3,6-NTSS treated emulsion from FIGS. 7C, 7D and 7E. FIG. 8A shows data 82 for the starting emulsion from FIG. 7A, while FIG. 8B shows data 84 for the 1,3,6-NTSS treated emulsion. Again, the emulsion was a 30% water-in-naptha diluted Athabasca bitumen. An order of magnitude increase in droplet diameter was observed upon 1,3,6-NTSS treatment of the emulsion from FIGS. 7C, 7D and 7E. It is observed that mean droplet diameters 80 increased from about 5 microns to about 50 microns from FIG. 8A to FIG. 8B. It is noted that the diameter of a water droplet is proportional to the speed at which it settles out of an emulsion. This is evidenced through the application of Stokes Law which calculates the rate of gravity separation of water droplets as:

$$\frac{2g(d_w - d_o)\sum n_i r_i^5}{9\eta_o \sum 4/3\pi n_i r_i^3}$$

In applying Stokes settling law to the sample treated with 1,3,6-NTSS, the rate of settling equals a value where g is the acceleration due to gravity, $d_w$ and $d_o$ is the density of the water and oil respectively and r is the radius of the droplets. Upon treatment with 1,3,6-NTSS, there exists a potential for a 100-fold increase in settling or oil/water separation rate compared to the control. Therefore, treatment with 1,3,6-NTSS increases the water droplet size and, in turn, decreases the amount of time it takes for the droplet to settle to the bottom of a vessel resulting in more efficient demulsification.

While it will be apparent that the invention herein described is well calculated to achieve the benefits and advantages set forth above, it will be appreciated that the invention is susceptible to modification, variation and change without departing from the spirit thereof.

What is claimed is:

1. A method of demulsifying a water-in-oil emulsion, comprising:

treating a volume of fluids comprising a water-in-oil emulsion by adding a salt of a polynuclear, aromatic sulfonic acid to the fluids to cause oil and water to be at least partially demulsified, wherein the polynuclear, aromatic sulfonic acid is a polynuclear aromatic group that contains no alkyl substituents.

2. The method of claim 1, wherein the oil in the fluids comprises heavy oil.

3. The method of claim 1, wherein the oil in the fluids comprises at least one of heavy oil, bitumen, crude oil distillates and synthetic oils.

4. The method of claim 1, wherein the volume of fluids further comprises stabilizing fine solids.

5. The method of claim 4, wherein the fine solids comprise at least one of silica, clay, and $BaSO_4$.

6. The method of claim 1, wherein the volume of fluids further comprises one or more of asphaltenes, naphthenic acid compounds, resins, and mixtures thereof.

7. The method of claim 1, wherein the water-in-oil emulsion contains dissolved inorganic salts of chloride, sulfates or carbonates of Group I and II elements.

8. The method of claim 1, wherein the salt of the polynuclear, aromatic sulfonic acid has the structure:

$$Ar—(SO_3^-X^+)_n$$

where:

"Ar" is a homonuclear or heteronuclear aromatic ring of at least 6 carbon atoms, "X" is selected from Group I and II elements, and "n" ranges from 1 to 10.

9. The method of claim 8, wherein:

"X" is selected from the group of elements consisting of sodium, potassium, calcium and magnesium.

10. The method of claim 1, wherein the salt is a sodium salt.

11. The method of claim 1, wherein the salt is one of a sodium salt, a potassium salt, a calcium salt and a magnesium salt.

12. The method of claim 1, wherein the polynuclear, aromatic sulfonic acid is 1-naphthalene sulfonic acid.

13. The method of claim 1, wherein the polynuclear, aromatic sulfonic acid is 2,6 naphthalene disulfonic acid.

14. The method of claim 1, wherein the polynuclear, aromatic sulfonic acid is 1,5 naphthalene disulfonic acid.

15. The method of claim 1, wherein the polynuclear, aromatic sulfonic acid is 1,3,6 naphthalene trisulfonic acid.

16. The method of claim 1, wherein the polynuclear, aromatic sulfonic acid is 1,3,6,8 pyrene tetrasulfonic acid.

17. The method of claim 1, wherein the oil in the fluids comprises heavy oil, and treating the volume of fluids is performed at a production site.

18. The method of claim 1, wherein the oil in the fluids comprises a heavy oil—light oil blend, and treating the volume of fluids is performed in a refinery desalter.

19. The method of claim 1, wherein the polynuclear, aromatic sulfonic acid is present in a concentration of from about 0.001% weight to about 5.0% weight of the water-in-oil emulsion.

20. The method of claim 1, wherein the polynuclear, aromatic sulfonic acid is present in the water-in-oil emulsion in a concentration of from about 10 parts per million (ppm) to about 1,000 ppm.

21. The method of claim 1, further comprising separating water from oil in a separator.

22. The method of claim 21, wherein the separator comprises at least one of a centrifugation separator, a gravity settling separator, a hydrocyclone, a separator that applies an electrostatic field, and a separator that applies microwave treatment.

23. A method of producing hydrocarbons from a subsurface reservoir, comprising:

producing hydrocarbons through a wellbore, the produced hydrocarbons having a water-in-oil emulsion; and subjecting the water-in-oil emulsion to a salt of a polynuclear, aromatic sulfonic acid additive to cause oil and water in the produced hydrocarbons to be at least partially demulsified, wherein the polynuclear, aromatic sulfonic acid is a polynuclear aromatic group that contains no alkyl substituents.

24. The method of claim 23, further comprising separating the water from the oil in a separator.

25. The method of claim 24, wherein the separator comprises at least one of a centrifugation separator, a gravity settling separator, a hydrocyclone, a separator that applies an electrostatic field, and a separator that applies microwave treatment.

26. The method of claim 24, wherein the oil in the water-in-oil emulsion comprises heavy oil, and subjecting the water-in-oil emulsion to the salt of the polynuclear, aromatic sulfonic acid is performed at a production site.

27. The method of claim 24, wherein the oil in the produced hydrocarbons comprises a heavy oil—light oil blend, and subjecting the water-in-oil emulsion to the salt of the polynuclear, aromatic sulfonic acid is performed in a refinery desalter.

28. The method of claim 24, wherein the oil in the produced hydrocarbons comprises heavy oil, and subjecting the water-in-oil emulsion to the salt of the polynuclear, aromatic sulfonic acid is performed by injecting the salt of the polynuclear, aromatic sulfonic acid into the wellbore.

29. The method of claim 28, wherein the oil in the produced hydrocarbons comprises heavy oil, and subjecting the water-in-oil emulsion to the salt of the polynuclear, aromatic sulfonic acid is performed by injecting the salt of the polynuclear, aromatic sulfonic acid through the wellbore and into a reservoir formation from which the hydrocarbons are produced.

30. The method of claim 23, wherein the salt is a sodium salt.

31. The method of claim 23, wherein the salt is a potassium salt.

32. The method of claim 23, wherein the polynuclear, aromatic sulfonic acid is 1-naphthalene sulfonic acid.

33. The method of claim 23, wherein the polynuclear, aromatic sulfonic acid is 2,6-naphthalene disulfonic acid.

34. The method of claim 23, wherein the polynuclear, aromatic sulfonic acid is 1,5-naphthalene disulfonic acid.

35. The method of claim 23, wherein the polynuclear, aromatic sulfonic acid is 1,3,6-naphthalene trisulfonic acid.

36. The method of claim 23, wherein the polynuclear, aromatic sulfonic acid is 1,3,6,8-pyrene tetrasulfonic acid.

37. A method of demulsifying a water-in-oil emulsion, comprising:

producing a volume of fluids comprising the water-in-oil emulsion;

treating the water-in-oil emulsion with an additive comprising a salt of a polynuclear, aromatic sulfonic acid to cause the oil and water of the fluids to be at least partially demulsified, wherein the polynuclear, aromatic sulfonic acid is a polynuclear aromatic group that contains no alkyl substituents and wherein the additive has the structure:

$$Ar—(SO_3^-X^+)_n$$

with:

"Ar" being a homonuclear or heteronuclear aromatic ring of at least 6 carbon atoms, "X" is selected from Group I and II elements, and "n" ranges from 1 to 10.

38. The method of claim 37, wherein "X" is selected from the group of elements consisting of sodium, potassium, calcium and magnesium.

39. The method of claim 38, wherein the fluids further comprise at least one of fine mineral solids, asphaltenes, organic acids, basic nitrogen compounds, and mixtures thereof.

40. The method of claim 39, wherein the oil in the water-in-oil emulsion comprises heavy crude oil.

41. The method of claim 38, wherein polynuclear, aromatic sulfonic acid is 1-naphthalene sulfonic acid.

42. The method of claim 38, wherein the polynuclear, aromatic sulfonic acid is 2,6-naphthalene disulfonic acid.

43. The method of claim 38, wherein the polynuclear, aromatic sulfonic acid is 1,5-naphthalene disulfonic acid.

44. The method of claim 38, wherein the polynuclear, aromatic sulfonic acid is 1,3,6-naphthalene trisulfonic acid.

45. The method of claim 38, wherein the polynuclear, aromatic sulfonic acid is 1,3,6,8-pyrene tetrasulfonic acid.

46. The method of claim 38, wherein the oil in the fluids comprises heavy crude oil, and treating the water-in-oil emulsion is performed at a production site.

47. The method of claim 38, wherein the polynuclear, aromatic sulfonic acid is present in a concentration of from about 0.001% weight to about 5.0% weight of the water-in-oil emulsion.

48. The method of claim 38, wherein the additive further comprises a delivery solvent.

49. The method of claim 48, wherein the delivery solvent is present in an amount of from about 35% weight to about 75% weight in the demulsifier, included in the weight percent of the additive added to the water-in-oil emulsion.

50. The method of claim 38, wherein the polynuclear, aromatic sulfonic acid is present in the water-in-oil emulsion in a concentration of from about 10 parts per million (ppm) to about 1,000 ppm.

51. The method of claim 37, wherein the salt is one of a sodium salt, a potassium salt, a calcium salt, and a magnesium salt.

* * * * *